US007287448B2

(12) United States Patent
Hu

(10) Patent No.: US 7,287,448 B2
(45) Date of Patent: Oct. 30, 2007

(54) REVERSIBLE HIGH-TORQUE SCREWDRIVER

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 48 days.

(21) Appl. No.: 11/160,939

(22) Filed: Jul. 15, 2005

(65) Prior Publication Data

US 2006/0048610 A1 Mar. 9, 2006

(30) Foreign Application Priority Data

Jul. 23, 2004 (TW) ..... 93122236 A

(51) Int. Cl.
*B25B 13/00* (2006.01)
*B25B 13/46* (2006.01)

(52) U.S. Cl. ..... 81/60; 81/58.4; 81/61; 81/62; 81/63.1

(58) Field of Classification Search ..... 80/60–63.2, 80/58.4

See application file for complete search history.

(56) References Cited

U.S. PATENT DOCUMENTS 5,535,648 A * 7/1996 Braun et al. ..... 81/63.1
5,582,081 A * 12/1996 Lin ..... 81/63.1
5,687,820 A * 11/1997 Lin ..... 192/43.2
5,974,915 A * 11/1999 Chou ..... 81/63.1
6,047,801 A * 4/2000 Liao ..... 192/43.2
6,370,988 B1 * 4/2002 Thompson et al. ..... 81/63.1
6,644,147 B1 * 11/2003 Huang ..... 81/62
6,679,363 B1 * 1/2004 Marchant ..... 192/43.1
6,925,912 B2 * 8/2005 Huang ..... 81/62

OTHER PUBLICATIONS

Taiwan Patent Publication No. 354932, Mar. 21, 1999, 4 pages.
Taiwan Patent Publication No. 527993, Apr. 11, 2003, 8 pages.
Taiwan Patent Publication No. M241178, Aug. 21, 2004, 8 pages.

* cited by examiner

*Primary Examiner*—Joseph J. Hail, III
*Assistant Examiner*—Bryan R. Muller
(74) *Attorney, Agent, or Firm*—Alan Kamrath; Kamrath & Associates P.A.

(57) ABSTRACT

A screwdriver includes a handle, a first body having an end securely mounted in the handle, a second body rotatably mounted in the first body, a ratcheting mechanism slidably mounted in a receiving section in the other end of the first body, and a switch member pivotally mounted to the other end of the first body. The switch member is pivotable between a first position and a second position to control engagement/disengagement of the ratcheting mechanism with/from teeth of the second body and to control relative rotation between the first body and the second body. A reinforcing member is provided in the receiving section to withstand high-torque operation.

19 Claims, 10 Drawing Sheets

REVERSIBLE HIGH-TORQUE SCREWDRIVER

FIELD OF THE INVENTION

The present invention relates to a high-torque screwdriver. In particular, the present invention relates to reversible high-torque screwdriver.

BACKGROUND OF THE INVENTION

Taiwan Utility Model Publication No. 354932 discloses a reversible high-torque screwdriver comprising a handle, a mounting seat fixed to an end of the handle, a gear wheel mounted in a longitudinal blind hole defined in the mounting seat, and a bit mounted to a square coupling hole defined in a side of the gear wheel. A pawl is received in a groove in the mounting seat and includes a first toothed section and a second toothed section for selective engagement with teeth on an outer periphery of the gear wheel. The pawl can be moved by a switch member that comprises a disc to which an elastic element is mounted. The first toothed section of the pawl is disengaged from the gear wheel, and the second toothed section is engaged with the gear wheel to allow the screwdriver to drive a fastener or the like in a first direction and to turn freely in a second direction opposite to the first direction. The position of the pawl can be switched by the switch member such that the first toothed section of the pawl is engaged with the gear wheel and that the second toothed section of the pawl is disengaged from the gear wheel to allow the screwdriver to drive the fastener in the second direction and to turn freely in the first direction.

The mounting scat has a complicated shape and a small size and is thus difficult to process. To solve this problem, the mounting seat is generally formed of zinc alloy by injection molding. The wall delimiting the groove of the mounting seat could only bear low torque imparted by the pawl, as zinc alloy is not strong. When high torque is applied to the screwdriver, the pawl made of rigid material would cause deformation or fracture of the wall delimiting the groove of the mounting seat, resulting in malfunction of the screwdriver. Namely, the screwdriver in fact could not provide high-torque operation. Similar problems exist in Taiwan Utility Model Publication Nos. 527993 and M241178.

SUMMARY OF THE INVENTION

In accordance with an aspect of the present invention, a screwdriver comprises a handle, a first body, a second body, a ratcheting mechanism, and a switch member. The first body comprises a first end securely mounted in the handle and a second end. The second end of the first body includes a receiving section and an axial hole in communication with the receiving section, with the receiving section including a peripheral wall. The second body is rotatably mounted in the axial hole of the first body. A plurality of teeth are formed on an outer periphery of the second body.

The ratcheting mechanism is slidably mounted in the receiving section for releasably engaging with the teeth of the second body. The switch member is pivotally mounted to the second end of the first body. The switch member is pivotable between a first position and a second position to control engagement/disengagement of the ratcheting mechanism with/from the teeth of the second body and to control relative rotation between the first body and the second body.

At least one reinforcing member is mounted to the peripheral wall of the receiving section. The ratcheting mechanism presses against the at least one reinforcing member when the switch member is in one of the first position and the second position.

In an example of the invention, the peripheral wall of the receiving section comprises two wall portions. The ratcheting mechanism comprises two pawls slidably mounted in the receiving section. Each pawl comprises a plurality of teeth on a side thereof for releasably engaging with the teeth of the second body. Each pawl further comprises a pressing face for releasably pressing against an associated one of the wall portions of the receiving section. An elastic element is mounted between the pawls.

When the switch member is in the first position, the teeth of one of the pawls are disengaged from the teeth of the second body whereas the teeth of the other pawl are engaged with the teeth of the second body, and the pressing face of the one of the pawls is disengaged from the associated one of the wall portions of the receiving section whereas the pressing face of the other pawl presses against the associated one of the wall portions of the receiving section, allowing clockwise driving rotation and counterclockwise free rotation of the screwdriver.

When the switch member is in the second position, the teeth of the one of the pawls are engaged with the teeth of the second body whereas the teeth of the other pawl are disengaged from the teeth of the second body, and the pressing face of the one of the pawls presses against the associated one of the wall portions of the receiving section whereas the pressing face of the other pawl is disengaged from the associated one of the wall portions of the receiving section, allowing counterclockwise driving rotation and clockwise free rotation of the screwdriver.

Preferably, the switch member is retainable in a third position between the first position and the second position. When the switch member is in the third position, the teeth of each pawl are engaged with the teeth of the second body, and the pressing face of each pawl presses against the associated one of the wall portions of the receiving section, allowing driving rotation of the screwdriver in either direction.

Preferably, the second end of the first body comprises a radial hole in communication with the axial hole. A positioning member and an elastic element are mounted in the radial hole. The switch member comprises two or three retaining grooves respectively corresponding to the two or three positions of the switch member. The positioning member is biased by the elastic element into one of the retaining grooves.

Preferably, the second body comprises an axially extending coupling hole for releasably coupling with an end of a bit.

Preferably, the second body comprises a groove defined in an end thereof, and a retainer is mounted in the groove for retaining the bit in place.

Preferably, the screwdriver further comprises at least one washer mounted between the handle and the first body for allowing smooth rotation of the bit.

Preferably, the switch member comprises a longitudinal through-hole through which an end of the second body extends out of the switch member.

In an example of the invention, the switch member comprises an end wall having an inner face. Two actuating pieces are formed on the inner face of the end wall of the switch member for selectively actuating the pawls when the switch member is moved to one of the first position and the second position.

In another example of the invention, the switch member comprises an end wall and a peripheral wall. The end wall comprises a longitudinal through-hole through which an end of the second body extends out of the switch member. Two actuating pieces are formed on an inner face of the end wall of the switch member for selectively actuating the pawls when the switch member is moved to one of the first position and the second position.

Preferably, the end face of the second end of the first body comprises a guide groove, and the inner face of the end wall of the switch member comprises a guide slidably received in the guide groove of the first body.

Preferably, the reinforcing member is made of steel.

Preferably, the second end of the first body comprises an annular groove in an outer periphery thereof. The switch member comprises an annular groove in an inner periphery thereof and a radial slot in communication with the annular groove. A C-clip is partially received in the annular groove of the first body and partially received in the annular groove of the switch member, allowing the switch member to pivot relative to the first body. The C-clip comprises two ends extending into the radial slot and respectively engaging with two sidewalls delimiting the radial slot.

In accordance with another aspect of the present invention, a reinforcing member is provided for a high-torque screwdriver. The reinforcing member is made of high-strength steel and mounted in a receiving section of a high-torque screwdriver. The reinforcing member is mounted between a ratcheting mechanism of the high-torque screwdriver and a peripheral wall of a receiving section. The ratcheting mechanism presses against the reinforcing member such that the reinforcing member withstands the pressing force and friction force from the ratcheting mechanism when the high-strength screwdriver is turned.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
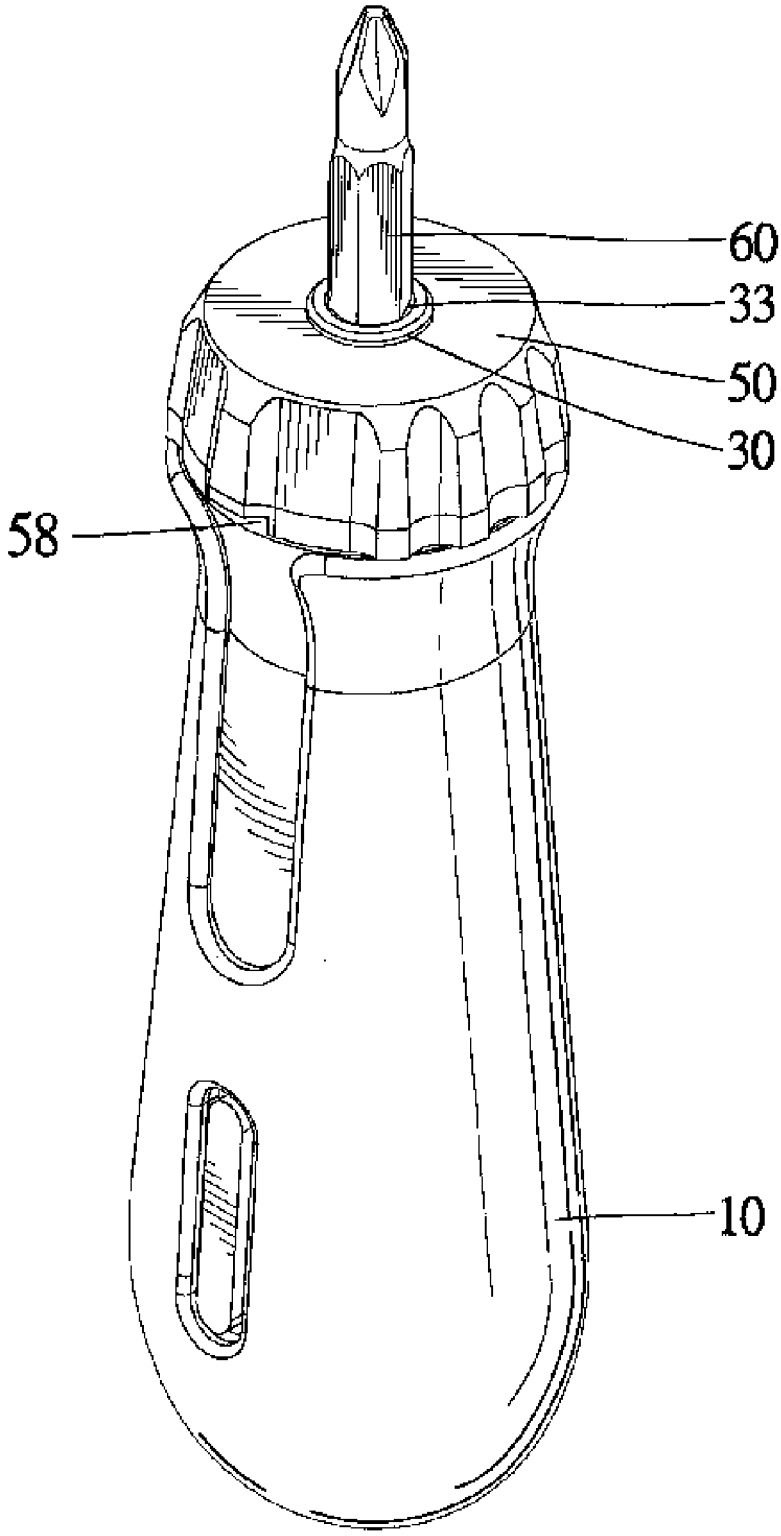
FIG. 1 is a perspective view of a reversible high-torque screwdriver in accordance with the present invention, wherein a bit is mounted to the screwdriver.
Figure 2:
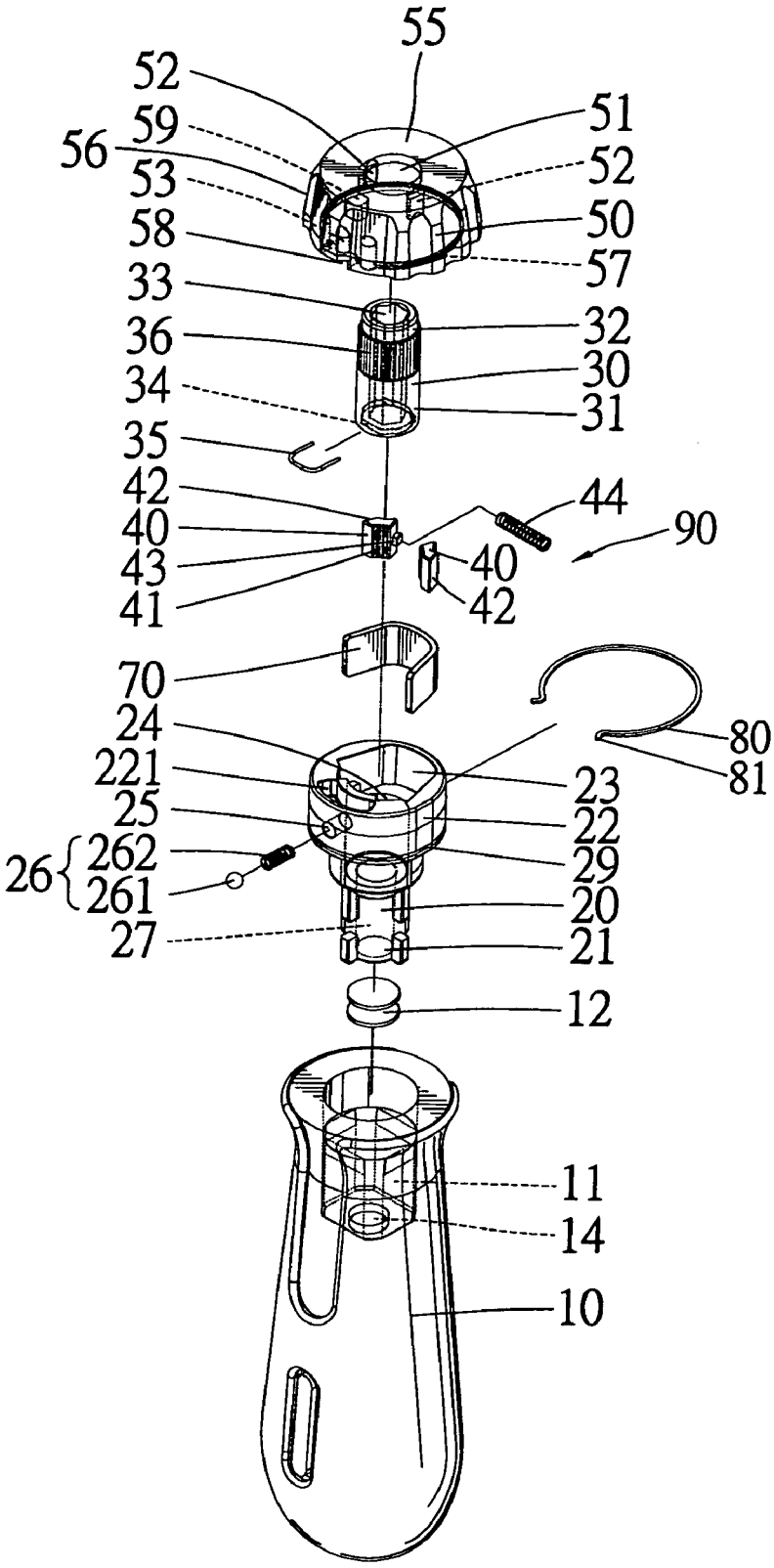
FIG. 2 is an exploded perspective view of the reversible high-torque screwdriver in FIG. 1.

Referring to FIGS. 1 and 2, a first embodiment of a reversible high-torque screwdriver in accordance with the present invention comprises a handle 10, a first body 20, a second body 30, a ratcheting mechanism 90, and a switch member 50. The handle 10 includes a hole 11 in an end thereof.

Figure 3:
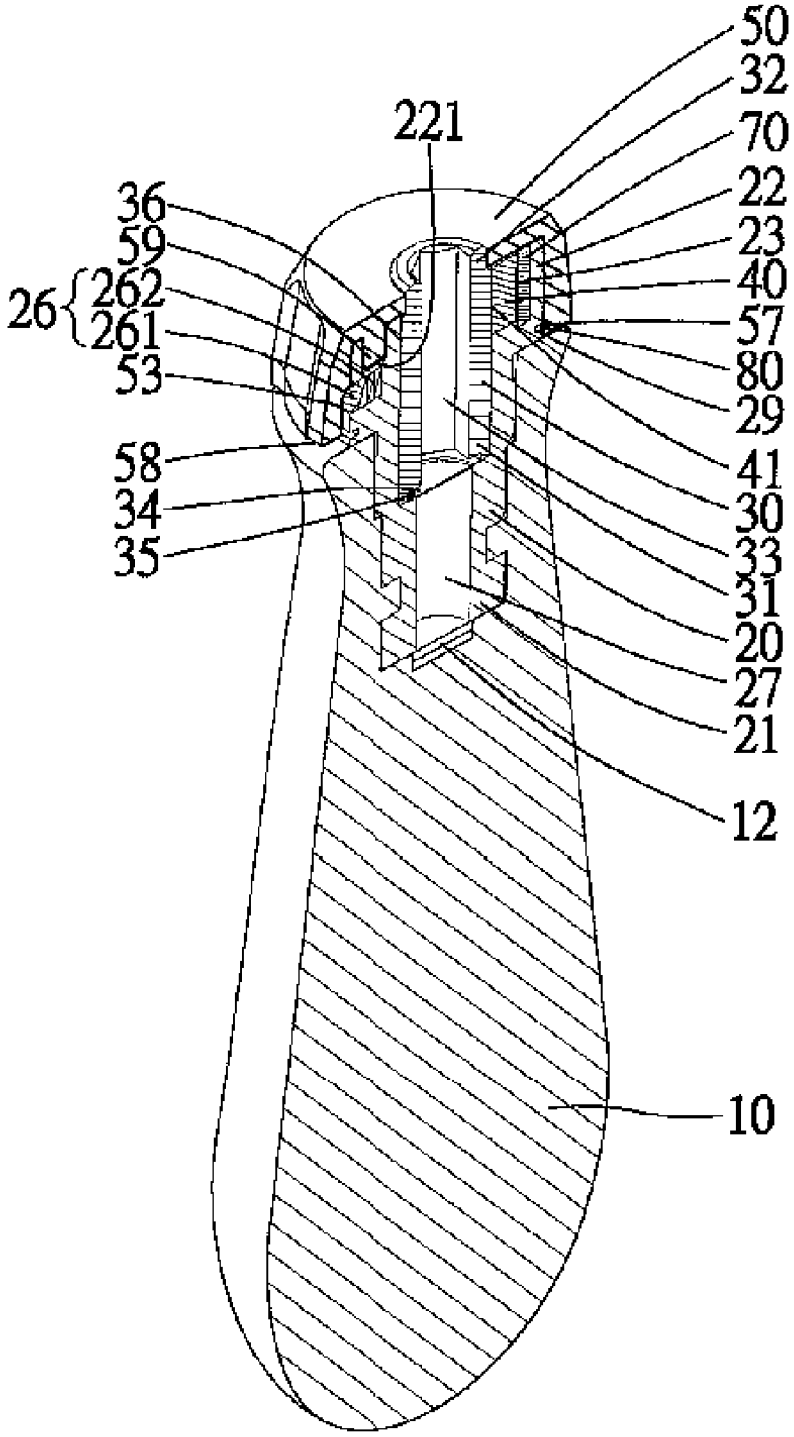
FIG. 3 is a longitudinal cutaway view of the reversible high-torque screwdriver in FIG. 2.

The first body 20 includes a first end 21 securely mounted in the hole 111 of the handle 10 and a second end 22 for rotatably holding the second body 30. The first body 20 may be made of zinc alloy by injection molding for easy manufacturing purposes. As illustrated in FIG. 3, at least one washer 12 (two in this embodiment) is mounted between the first body 20 and the handle 10 for allowing smooth rotation of the bit 60. In this embodiment, the washers 12 are received in a receptacle 14 defined in an end wall delimiting the hole 11 of the handle 10.

The second end 22 of the first body 20 includes a receiving section 23 and an axial hole 24 in communication with the receiving section 23. The second end 22 of the first body 20 further includes a radial hole 25 in communication with the axial hole 24. A positioning means 26 is mounted in the radial hole 25. In the illustrated embodiment, the positioning means 26 includes a positioning member 261 (a ball in this embodiment) and an elastic element 262 for biasing the positioning member 261. An annular groove 29 is defined in an outer periphery of the second end 22 of the first body 20. An extension hole 27 extends from the axial hole 24 to the first end 21 of the first body 20. The extension hole 27 is aligned with the receptacle 14 of the handle 10 when the first body 20 is mounted in the hole 11 of the handle 10. Further, a guide groove 221 is defined in an end face of the second end 22 of the first body 20.

The second body 30 is rotatably mounted in the axial hole 24 of the second end 22 of the first body 20 and includes a first end 31 and a second end 32. The second body 30 further includes a coupling hole 33 that extends axially and that is aligned with the extension hole 27 of the first body 20, best shown in FIG. 3. Defined in the first end 31 of the second body 30 is a groove 34 into which a retainer 35 (e.g., a clip) is mounted. A plurality of teeth 36 are formed on an outer periphery of the second end 32 of the second body 30, which will be described later.

The ratcheting mechanism 90 comprises two pawls 40 that are slidably mounted in the receiving section 23. Each pawl 40 includes a plurality of teeth 41 on a side thereof that faces the second body 30. Each pawl 40 further includes a pressing face 42. Each pawl 40 further includes a peg 43 on an inner end thereof that is proximal to the other pawl 40, with two ends of an elastic element 44 respectively attached to the pegs 43 for biasing the pawls 40 away from each other.

Figure 4:
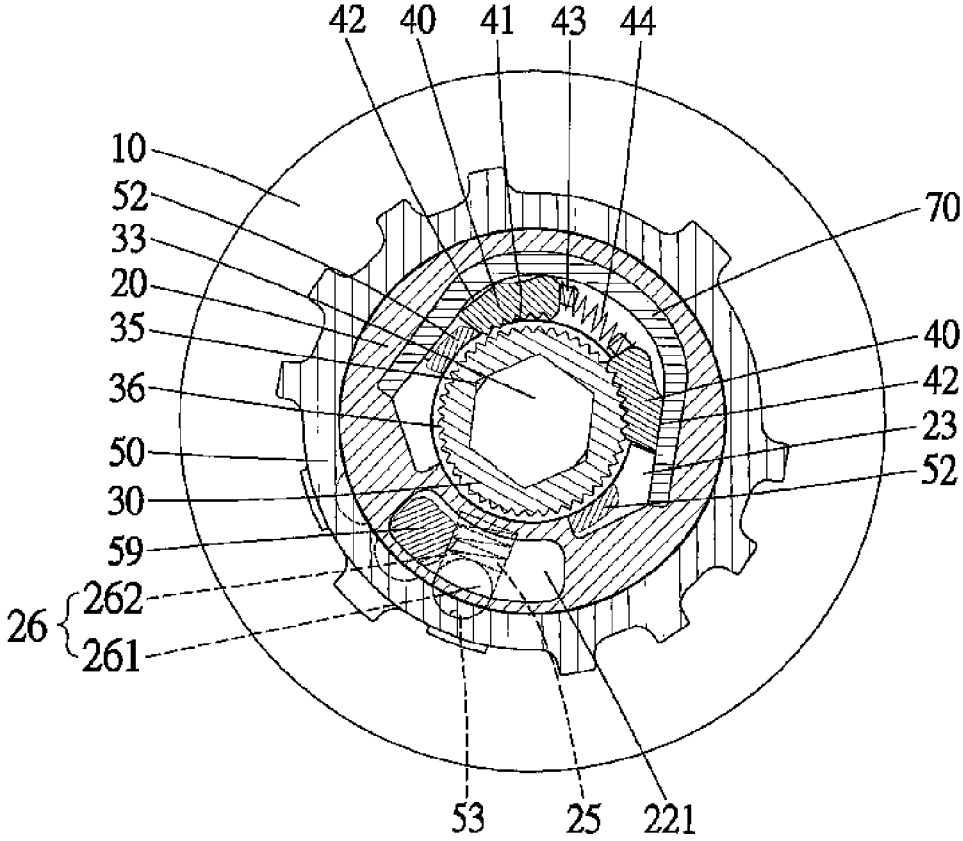
FIG. 4 is a sectional view of the reversible high-torque screwdriver in FIG. 2, wherein the screwdriver is in a state allowing clockwise driving rotation and counterclockwise free rotation.

The switch member 50 is pivotally mounted to the second end 22 of the first body 20. The switch member 50 includes an end wall 55 and a peripheral wall 56. A longitudinal through-hole 51 is defined in the end wall 55. Further, two actuating pieces 52 are formed on an inner face of the end wall 55 of the switch member 50 and located in the receiving section 23 of the first body 20. As illustrated in FIG. 4, the actuating pieces 52 are located on outer sides of the pawls 40. The switch member 50 further includes three retaining grooves 53 in the peripheral wall 56.

Further, an annular groove 57 is defined in an inner periphery of the peripheral wall 56 of the switch member 50, and a radial slot 58 is defined in the peripheral wall 56 and in communication with the annular groove 57. A C-clip 80 is partially received in the annular groove 29 of the first body 20 and partially received in the annular groove 57 of the switch member 50. Thus, the switch member 50 is reliably and pivotally connected to the second end 22 of the first body 20. Two ends 81 of the C-clip 80 are extended into the radial slot 58 of the switch member 50 and, respectively, engaged with two sidewalls delimiting the radial slot 58, preventing the C-clip 80 from wobbling or swaying during operation. A guide 59 is formed on the inner face of the end wall 55 of the switch member 50 and slidably received in the guide groove 221 of the first body 20.

When the switch member 50 is in a position shown in FIG. 4, the positioning member 261 of the positioning means 26 is retained in a first one (the right one) of the retaining grooves 53 of the switch member 50 under the action of the elastic element 262. The left pawl 40 is moved by the associated actuating piece 52 of the switch member 50, whereas the right pawl 40 is not moved. The pressing face 42 of the left pawl 40 is disengaged from a wall portion of a peripheral wall of the receiving section 23 of the first body 20, whereas the pressing face 42 of the right pawl 40 presses against another wall portion of the peripheral wall of the receiving section 23 of the first body 20. Further, the teeth 41 of the left pawl 40 are disengaged from the teeth 36 of the second body 30, whereas the teeth 41 of the right pawl 40 are engaged with the teeth 36 of the second body 30. Thus, the reversible high-torque screwdriver is in a state allowing clockwise driving rotation for driving a screw or the like and counterclockwise free rotation in which the screw is not driven.

Figure 5:
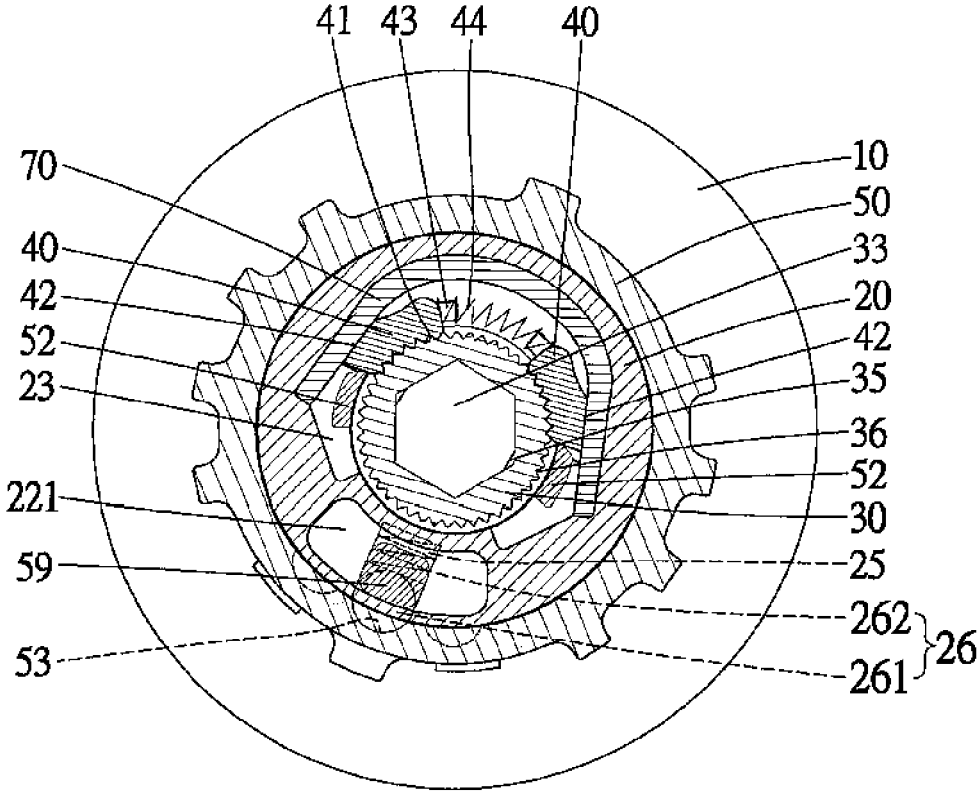
FIG. 5 is a sectional view similar to FIG. 4, wherein the screwdriver is in a state allowing driving rotation in either direction.

When the switch member 50 is turned (counterclockwise in this example) to a position shown in FIG. 5, the positioning member 261 of the positioning means 26 is retained in a second one (the middle one) of the retaining grooves 52 of the switch member 50 under the action of the elastic element 262. None of the pawls 40 is moved by the actuating pieces 52 of the switch member 50. The pressing faces 42 of the pawls 40 press against the associated wall portions of the receiving section 23 of the first body 20. Further, the teeth 41 of each pawl 40 are engaged with the teeth 36 of the second body 30. Thus, the screwdriver is in a state allowing driving rotation in either direction.

Figure 6:
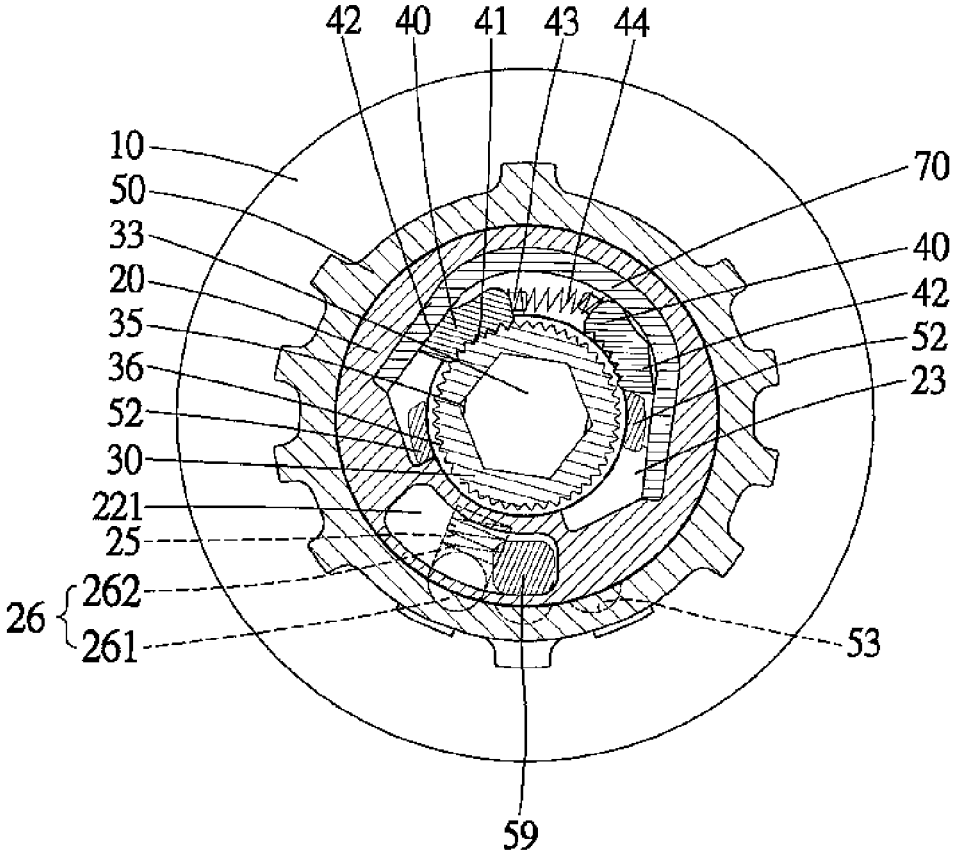
FIG. 6 is a sectional view similar to FIG. 4, wherein the screwdriver is in a state allowing counterclockwise driving rotation and clockwise free rotation.
Figure 7:
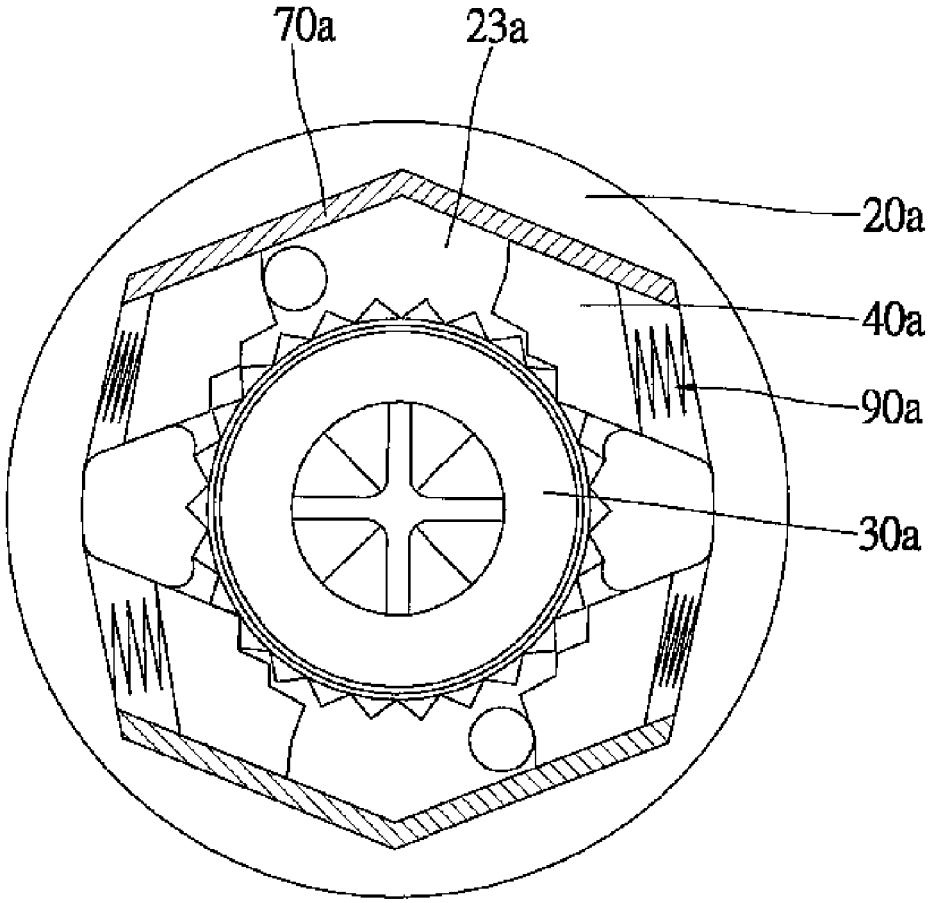
FIG. 7 is a sectional view illustrating a modified embodiment of the reversible high-torque screwdriver in accordance with the present invention.

When the switch member 50 is turned (counterclockwise in this example) to a position shown in FIG. 6, the positioning member 261 of the positioning means 26 is retained in a third one (the left one) of the retaining grooves 53 of the switch member 50 under the action of the elastic element 262. The right pawl 40 is moved by the associated actuating piece 52 of the switch member 50, whereas the left pawl 40 is not moved. The pressing face 42 of the right pawl 40 is disengaged from the associated wall portion of the receiving section 23 of the first body 20, whereas the pressing face 42 of the left pawl 40 presses against the associated wall portion of the receiving section 23 of the first body 20. Further, the teeth 41 of the right pawl 40 are disengaged from the teeth 36 of the second body 30, whereas the teeth 41 of the left pawl 40 are engaged with the teeth 36 of the second body 30. Thus, the screwdriver is in a state allowing counterclockwise driving rotation and clockwise free rotation.

It is noted that the pawls 40 and the actuating pieces 52 of the switch member 50 are concentrically mounted about the longitudinal axis of the screwdriver. The overall size of the screwdriver is reduced, and movement of the pawls 40 by turning the switch member 50 is easy and reliable.

Referring to FIG. 1, when an end of a bit 60 is inserted into the coupling hole 33 of the second body 30, the retainer 35 mounted in the first end 31 of the second body 30 securely clamps the end of the bit 60 by the resiliency of the retainer 35. This arrangement allows easy replacement of bits 60. It is noted that the washers 12 allow smooth rotation of the bit 60 when the end of the bit 60 is inserted into the coupling hole 33 of the second body 30 and in contact with the upper washer 12.

A reinforcing member 70 is mounted in the receiving section 23. In this embodiment, the reinforcing member 70 is substantially U-shaped and in contact with the peripheral wall of the receiving section 23. The reinforcing member 70 is made of steel or other high-strength material to reinforce the receiving section 23.

When the screwdriver is turned for driving a screw (not shown) or the like, since the reinforcing member 70 is made of high-strength material, deformation would not occur to the reinforcing member 70 and the receiving section 23 when the pressing faces 42 of the pawls 40 press against the reinforcing member 70. A high-torque reversible screwdriver is, thus, obtained without the risk of slipping or large play.

FIGS. 7 through 10 illustrate modified embodiments of the invention, wherein different ratcheting mechanisms 90*a*, 90*b*, 90*c*, 90*d* are illustrated. In the embodiment shown in FIG. 7, the ratcheting mechanism 90*a* includes four pawls 40*a* each biased by an elastic element (not labeled). Two reinforcing members 70*a* are mounted in the receiving section 23*a* of the first body 20*a* and in contact with the peripheral wall of the receiving section 23*a*. The pressing faces of the pawls 40*a* press against the associated reinforcing member(s) 70*a* when the pawls 40*a* are engaged with the second body 30*a*. A high-torque reversible screwdriver is, thus, obtained without the risk of slipping or large play.

Figure 8:
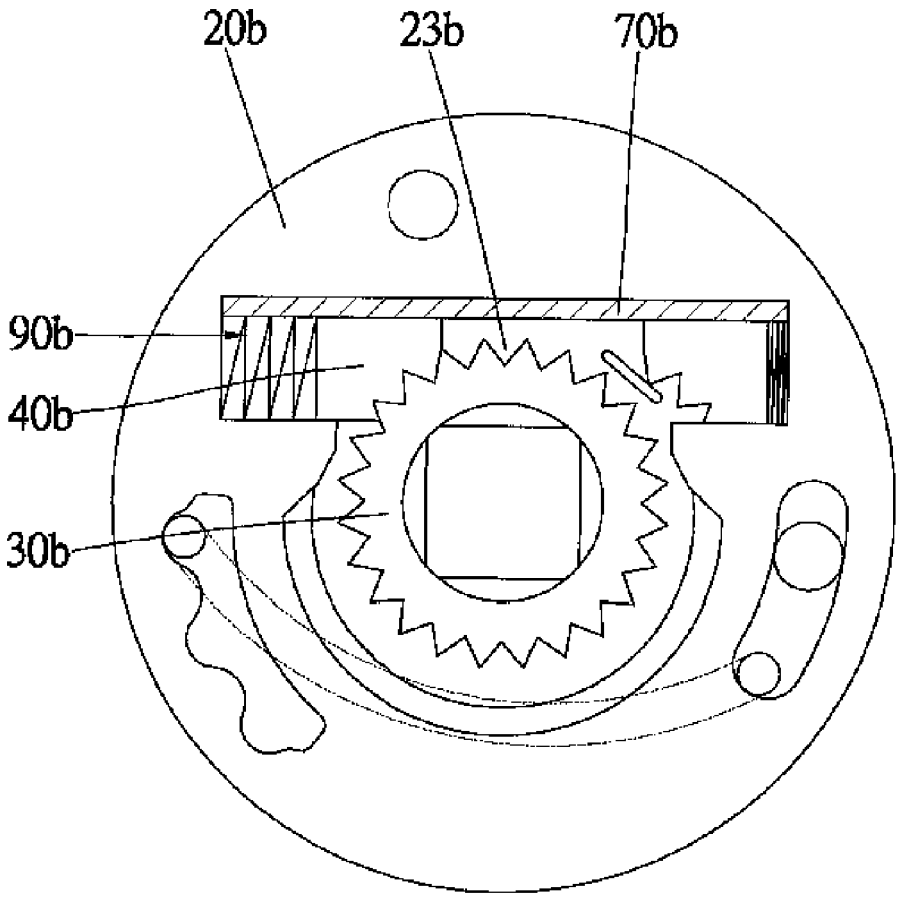
FIG. 8 is a sectional view illustrating another modified embodiment of the reversible high-torque screwdriver in accordance with the present invention.

In the embodiment shown in FIG. 8, the ratcheting mechanism 90*b* includes two pawls 40*b* each biased by an elastic element (not labeled). A reinforcing member 70*b* is mounted in the receiving section 23*b* of the first body 20*b* and in contact with the peripheral wall of the receiving section 23*b* of the first body 20*b*. The pressing faces of the pawls 40*b* of the ratcheting mechanism 90*b* press against the reinforcing member 70*b* when the pawls 40*b* are engaged with the second body 30*b*. A high-torque reversible screwdriver is, thus, obtained without the risk of slipping or large play.

Figure 9:
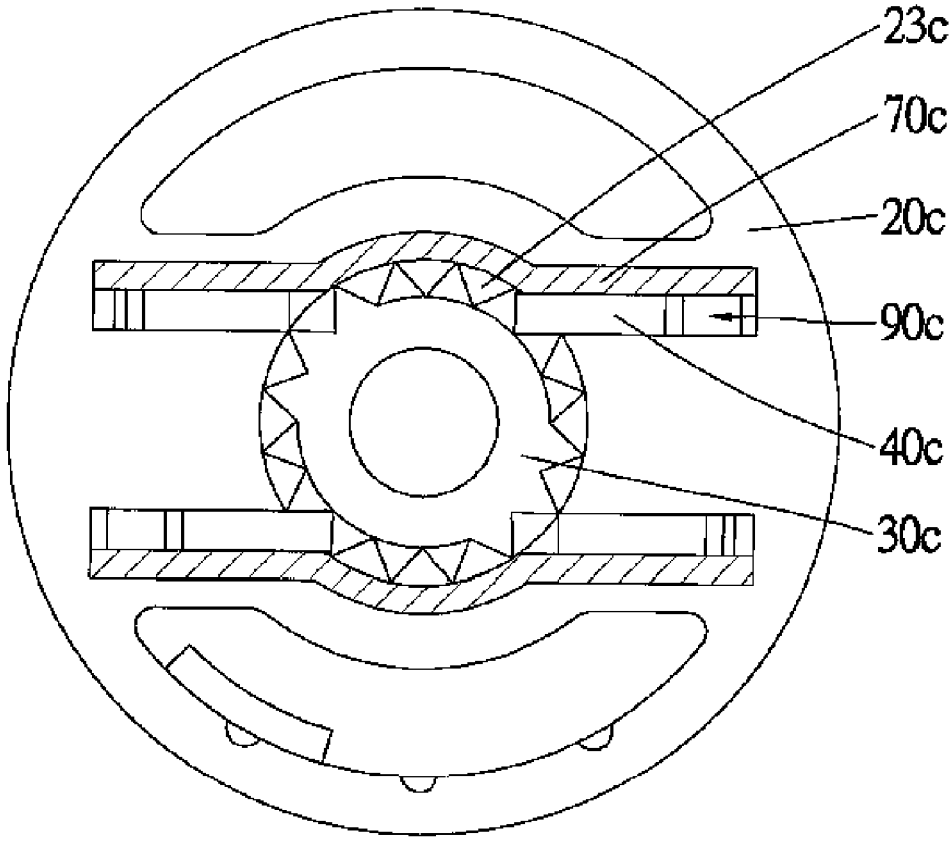
FIG. 9 is a sectional view illustrating a further modified embodiment of the reversible high-torque screwdriver in accordance with the present invention.

In the embodiment shown in FIG. 9, the ratcheting mechanism 90*c* includes four pawls 40*c* each biased by an elastic element (not labeled). Two reinforcing members 70*b* are mounted in the receiving section 23*c* of the first body 20*b* and in contact with the peripheral wall of the receiving section 23*c* of the first body 20*c*. The pressing faces of the pawls 40*b* of the ratcheting mechanism 90*c* press against the associated reinforcing member(s) 70*b* when the pawls 40*b* are engaged with the second body 30*c*. A high-torque reversible screwdriver is, thus, obtained without the risk of slipping or large play.

Figure 10:
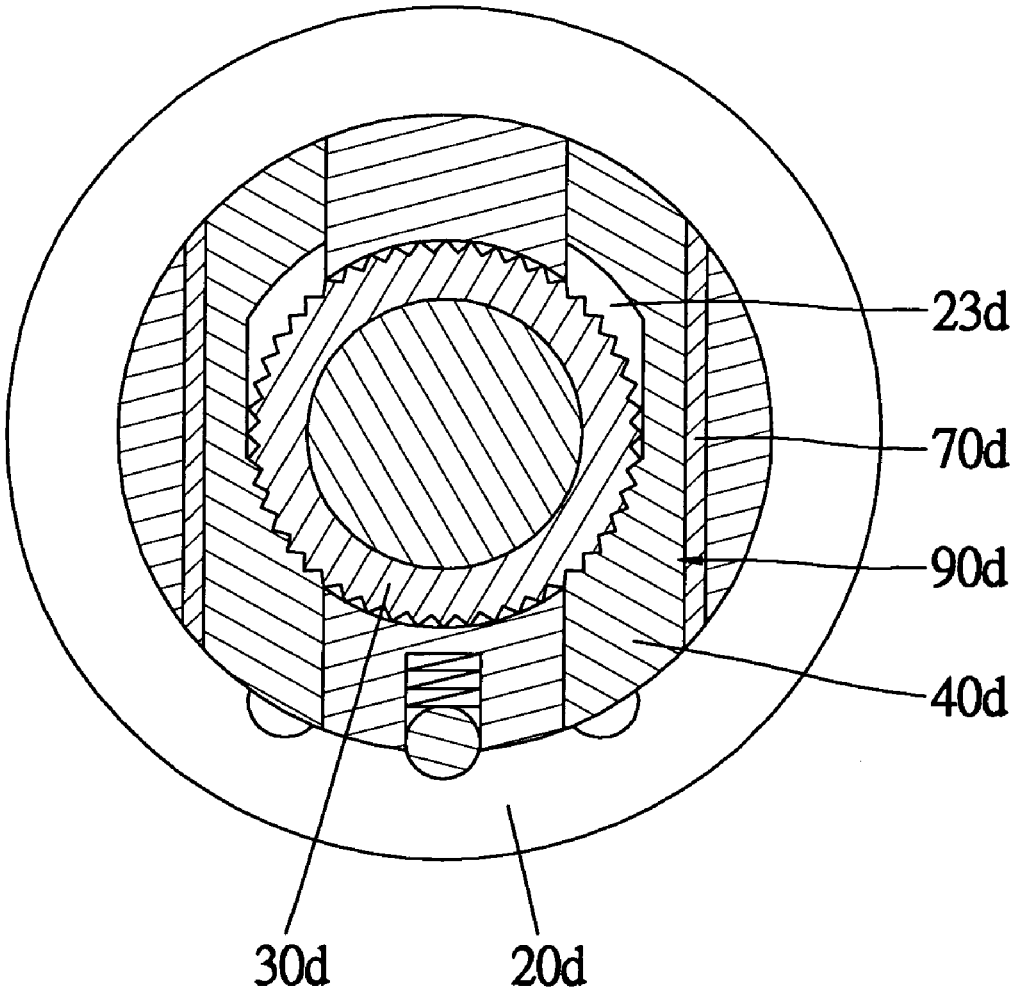
FIG. 10 is a sectional view illustrating still another modified embodiment of the reversible high-torque screwdriver in accordance with the present invention.

In the embodiment shown in FIG. 10, the ratcheting mechanism 90*d* includes two pawls 40*d* biased by an elastic element (not labeled). Two reinforcing members 70*d* are mounted in the receiving section 23*d* of the first body 20*d* and in contact with the peripheral wall of the receiving section 23*d* of the first body 20*d*. The pressing faces of the pawls 40*d* of the ratcheting mechanism 90*d* press against the associated reinforcing member(s) 70*d* when the pawls 40*d* are engaged with the second body 30*d*. A high-torque reversible screwdriver is, thus, obtained without the risk of slipping or large play.

Although specific embodiments have been illustrated and described, numerous modifications and variations are still possible without departing from the essence of the invention. The scope of the invention is limited by the accompanying claims.

What is claimed is:

1. A screwdriver comprising:

a handle;

a first body made of a first material, with the first body comprising a first end securely mounted in the handle and a second end, the second end of the first body including a receiving section and an axial hole in communication with the receiving section, the receiving section including a peripheral wall;

a second body rotatably mounted in the axial hole of the first body, a plurality of teeth being formed on an outer periphery of the second body;

a ratcheting mechanism slidably mounted in the receiving section for releasably engaging with the teeth of the second body;

a switch member pivotally mounted to the second end of the first body, the switch member being pivotable between a first position and a second position to control engagement/disengagement of the ratcheting mechanism with/from the teeth of the second body and to control relative rotation between the first body and the second body; and at least one reinforcing member mounted to the peripheral wall of the receiving section, with the at least one reinforcing member having a first arm and a second arm, with the first arm being at a non-parallel obtuse angle to the second arm, with the at least one reinforcing member being made of a second material, with the second material being different from and harder than the first material, with the at least one reinforcing member and the second body being formed separately, and with the at least one reinforcing member pushing against the peripheral wall of the receiving section;

and with the ratcheting mechanism pressing against said at least one reinforcing member when the switch member is in one of the first position and the second position, with the ratcheting mechanism comprising first and second pawls slidably mounted in the receiving section, with each said pawl comprising a plurality of teeth on a side thereof for releasably engaging with the teeth of the second body, with each said pawl further comprising a pressing face for releasably pressing against an associated one of the first and second arms of the reinforcing member, with an elastic element mounted between the first and second pawls, and with each said pawl located within the at least one reinforcing member and completely between the reinforcing member and the plurality of teeth of the second body.

2. The screwdriver as claimed in claim 1, wherein:

the second end of the first body comprises a radial hole located adjacent to the receiving section, a positioning member and an elastic element are mounted in the radial hole, the switch member comprises two retaining grooves respectively corresponding to the first position and the second position of the switch member, and the positioning member is biased by the elastic element into one of the retaining grooves.

3. The screwdriver as claimed in claim 1, wherein the second body comprises an axially extending coupling hole adapted to releasably couple with an end of a bit.

4. The screwdriver as claimed in claim 3, wherein the second body comprises a groove defined in an end thereof, and wherein a retainer is mounted in the groove for retaining the bit in place.

5. The screwdriver as claimed in claim 4, wherein the screwdriver further comprises at least one washer mounted between the handle and the first body for allowing smooth rotation of the bit.

6. The screwdriver as claimed in claim 1, wherein the switch member comprises a longitudinal through-hole through which an end of the second body extends out of the switch member.

7. The screwdriver as claimed in claim 1, wherein the reinforcing member is made of steel.

8. The screwdriver as claimed in claim 1, wherein the at least one reinforcing member is U-shaped and includes the first arm and the second arm as a single piece.

9. The screwdriver as claimed in claim 8, wherein:

the second end of the first body comprises a radial hole located adjacent to the receiving section, a positioning member and an elastic element are mounted in the radial hole, the switch member comprises two retaining grooves respectively corresponding to the first position and the second position of the switch member, and the positioning member is biased by the elastic element into one of the retaining grooves.

10. The screwdriver as claimed in claim 8, wherein:

the second end of the first body comprises an annular groove in an outer periphery thereof, the switch member comprises an annular groove in an inner periphery thereof and a radial slot in communication with the annular groove, a C-clip is partially received in the annular groove of the first body and partially received the annular groove of the switch member, allowing the switch member to pivot relative to the first body, and the C-clip comprises two ends extending into the radial slot and respectively engaging with two sidewalls delimiting the radial slot.

11. The screwdriver as claimed in claim 8, wherein:

when the switch member is in the first position, the teeth of one of the pawls are disengaged from the teeth of the second body whereas the teeth of the other pawl are engaged with the teeth of the second body, the pressing face of said one of the pawls is disengaged from the associated one of the first and second arms of the reinforcing member whereas the pressing face of the other pawl presses against the associated one of the first and second arms of the reinforcing member, allowing clockwise driving rotation and counterclockwise free rotation of the screwdriver; and when the switch member is in the second position, the teeth of said one of the pawls are engaged with the teeth of the second body whereas the teeth of the other pawl are disengaged from the teeth of the second body, the pressing face of said one of the pawls presses against the associated one of the first and second arms of the reinforcing member whereas the pressing face of the other pawl is disengaged from the associated one of the first and second arms of the reinforcing member, allowing counterclockwise driving rotation and clockwise free rotation of the screwdriver.

12. The screwdriver as claimed in claim 11, wherein:

the switch member comprises an end wall having an inner face, and two actuating pieces are formed on the inner face of the end wall of the switch member for selectively actuating the pawls when the switch member is moved to one of the first position and the second position.

13. The screwdriver as claimed in claim 12, wherein:

the second end of the first body comprises a radial hole located adjacent to the receiving section, a positioning member and an elastic element are mounted in the radial hole, the switch member comprises retaining grooves respectively corresponding to the first position and the second position of the switch member, and the positioning member is biased by the elastic element into one of the retaining grooves.

14. The screwdriver as claimed in claim 12, wherein:

the end face of the second end of the first body comprises a guide groove, and the inner face of the end wall of the switch member comprises a guide slidably received in the guide groove of the first body.

15. The screwdriver as claimed in claim 11, wherein:

the second end of the first body comprises a radial hole located adjacent to the receiving section, a positioning member and an elastic element are mounted in the radial hole, the peripheral wall of the switch member comprises two retaining grooves in an inner periphery thereof, the retaining grooves respectively correspond to the first position and the second position of the switch member, and the positioning member is biased by the elastic element into one of the retaining grooves.

16. The screwdriver as claimed in claim 11, wherein:

the second end of the first body comprises an annular groove in an outer periphery thereof, the switch member comprises an annular groove in an inner periphery thereof and a radial slot in communication with the annular groove, a C-clip is partially received in the annular groove of the first body and partially received the annular groove of the switch member, allowing the switch member to pivot relative to the first body, and the C-clip comprises two ends extending into the radial slot and respectively engaging with two sidewalls delimiting the radial slot.

17. The screwdriver as claimed in claim 11, wherein:

the switch member is retainable in a third position between the first position and the second position, when the switch member is in the third position, the teeth of each said pawl are engaged with the teeth of the second body, and the pressing face of each said pawl presses against the associated one of the first and second arms of the reinforcing member, allowing driving rotation of the screwdriver in either direction.

18. The screwdriver as claimed in claim 17, wherein:

the second end of the first body comprises a radial hole located adjacent to the receiving section, a positioning member and an elastic element are mounted in the radial hole, the switch member comprises three retaining grooves respectively corresponding to the first position, the second position, and the third position of the switch member, and the positioning member is biased by the elastic element into one of the retaining grooves.

19. The screwdriver as claimed in claim 17, wherein:

the second end of the first body comprises a radial hole located adjacent to the receiving section, a positioning member and an elastic element are mounted in the radial hole, the peripheral wall of the switch member comprises three retaining grooves in an inner periphery thereof, the retaining grooves respectively correspond to the first position, the second position, and the third position of the switch member, and the positioning member is biased by the elastic element into one of the retaining grooves.

* * * * *